US006917187B2

(12) United States Patent
Okubo et al.

(10) Patent No.: US 6,917,187 B2
(45) Date of Patent: Jul. 12, 2005

(54) STABILIZED DC POWER SUPPLY DEVICE

(75) Inventors: Takuya Okubo, Kyoto (JP); Koh Takemura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/716,674

(22) Filed: Nov. 20, 2003

(65) Prior Publication Data

US 2004/0100234 A1 May 27, 2004

(30) Foreign Application Priority Data

Nov. 21, 2002 (JP) ..... 2002-337786

(51) Int. Cl.[7] ..... G05F 1/565
(52) U.S. Cl. ..... 323/275
(58) Field of Search ..... 323/275–277, 323/280; 361/18, 79

(56) References Cited

U.S. PATENT DOCUMENTS 3,961,236 A * 6/1976 Rodek et al. ..... 323/236
5,191,278 A * 3/1993 Carpenter ..... 323/275
5,642,034 A * 6/1997 Amano ..... 323/277
5,708,356 A * 1/1998 Onodera ..... 323/275
5,939,867 A * 8/1999 Capici et al. ..... 323/277

FOREIGN PATENT DOCUMENTS

JP 8-123560 5/1996

* cited by examiner

*Primary Examiner*—Gary L Laxton
(74) *Attorney, Agent, or Firm*—Arent Fox PLLC

(57) ABSTRACT

According to the conventional stabilized DC power supply device, there is a possibility that the output transistor breaks down by heat when the input voltage fluctuates. To cope with this, the stabilized DC power supply device embodying the invention is so configured as to comprise an output transistor for converting an input voltage to an output voltage and feeding out the output voltage, a control circuit for controlling the output transistor so as to maintain a value of the output voltage constant, a current detection circuit for detecting an output current of the output transistor, a voltage detection circuit for detecting a voltage appearing between an input side and an output side of the output transistor, a multiplying circuit for multiplying an output of the current detection circuit and an output of the voltage detection circuit together, and a protection circuit for restricting a wattage power of the output transistor according to an output of the multiplying circuit.

5 Claims, 2 Drawing Sheets

STABILIZED DC POWER SUPPLY DEVICE

BACKGROUND OF THE INVENTION

1. Field of the Invention

The present invention relates to a stabilized DC (direct current) power supply device. More particularly, the present invention relates to a stabilized DC power supply device having an output transistor that converts a voltage inputted thereto to an output voltage and delivers the output voltage.

2. Description of the Prior Art

Among conventional stabilized DC power supply devices, there is a type of stabilized DC power supply device that uses an externally connected output transistor so that properties thereof can be changed in order to cope with a small-current output as well as a large-current output.

FIG. 3 is a circuit diagram showing a configuration example of a conventional stabilized DC power supply device having an externally connected output transistor. A positive side of a DC power source 2 is connected to a drain of an n-channel MOSFET 1 (metal-oxide semiconductor field-effect transistor) connected externally as an output transistor and a negative side of the DC power source 2 is connected to ground. A source of the MOSFET 1 is connected to an output terminal 3 by way of a current-sensing resistor R1. One side of a load resistor RL is connected to the output terminal 3 and another side thereof is connected to ground.

The DC power source puts out a voltage $V_{IN}$. It is to be noted that a value of the voltage $V_{IN}$ changes in accordance with a power source to be used as the DC power source 2. For example, the value of the voltage $V_{IN}$ differs depending on whether the DC power source 2 is a battery or a DC adapter. The MOSFET 1 delivers from the source thereof a voltage whose value is lower than the voltage $V_{IN}$ by a voltage incurred as a result of a voltage drop between the source and the drain thereof. Here, the voltage between the source and the drain of the MOSFET 1 changes according to a control signal to be fed to a gate thereof. Accordingly, an output voltage Vo at the output terminal 3 is equal to a value obtained by subtracting the voltage between the source and drain of the MOSFET 1 from the voltage $V_{IN}$. Note that a voltage drop incurred by the current-sensing resistor R1 is so small that it can be ignored in this description. The output voltage Vo becomes equal to a reference voltage $V_{REF}$ due to a negative feedback of an operational amplifier 4 and is fed out from the output terminal 3.

At the same time, an inverting input terminal of the operational amplifier 4 is connected to a node between the current-sensing resistor R1 and the output terminal 3. A positive side of a reference voltage source 5 is connected to a non-inverting input terminal of the operational amplifier 4 and a negative side of the reference voltage source 5 is connected to ground. Furthermore, an output terminal of the operational amplifier 4 is connected to the gate of the MOSFET 1.

The reference voltage source 5 delivers the reference voltage $V_{REF}$. The operational amplifier 4 feeds out the control signal that corresponds to a difference between the output voltage Vo and the reference voltage $V_{REF}$. In this way, it is possible to maintain the output voltage Vo at a constant value even if the load RL changes or the value of voltage $V_{IN}$ is changed. The output voltage Vo is regulated at an identical level with the reference voltage $V_{REF}$ by way of a negative feedback operation of the operational amplifier 4.

However, the stabilized DC power supply device shown in FIG. 3 operates in such a way as to reduce the output voltage Vo by way of restricting a drain current of the MOSFET 1 when the drain current increases so that an output current Io flowing through the load resistor RL is prevented from causing an overcurrent situation. A protection circuit for restricting the drain current is composed of the current sensing resistor R1, an operational amplifier 6, an operational amplifier 7, a constant current source 8, and an external resistor R2.

A non-inverting input terminal of the operational amplifier 6 is connected to a node between the MOSFET 1 and the resistor R1, and an inverting input terminal of the operational amplifier 6 is connected to a node between the resistor R1, the output terminal 3, and the operational amplifier 4. Furthermore, an output terminal of the operational amplifier 6 is connected to a non-inverting input terminal of the operational amplifier 7.

Also, one side of the constant current source 8 and one side of the external resistor R2 are connected to an inverting input terminal of the operational amplifier 7. A constant voltage Vc is supplied to the constant current source 8. Another side of the external resistor R2 is connected to ground. A signal fed out from an output terminal of the operational amplifier 7 achieves a gain control of the operational amplifier 4.

The protection circuit configured in said manner will operate as described below. A source current of the MOSFET 1 flows through the current-sensing resistor R1. Then, the operational amplifier 6 detects a potential difference across the current-sensing resistor R1 and feeds out a voltage signal corresponding to the potential difference. The operational amplifier 7 feeds out to the operational amplifier 4 a control signal corresponding to a voltage difference between the output of the operational amplifier 6 and a voltage determined by a resistance of the external resistor R2. The operational amplifier 4 changes its gain in accordance with the control signal fed from the operational amplifier 7 so that the drain current of the MOSFET is kept under a predetermined value to prevent the output current Io from causing an overcurrent situation. Accordingly, an Io-Vo characteristic of the conventional stabilized DC power supply device shown in FIG. 3 will be represented by a curve similar to "a cliff overhanging the sea" as shown in FIG. 4.

It is to be noted that the conventional stabilized DC power supply device shown in FIG. 3 comprises a semiconductor integrated circuit which incorporates the operational amplifiers 4, the operational amplifiers 6, the operational amplifiers 7, and the constant current source 8. Additionally, to that semiconductor integrated circuit, the MOSFET 1, the current-sensing resistor R1, and the external resistor R2 are externally connected respectively.

The stabilized DC power supply device shown in FIG. 3 is capable of preventing the output current Io from causing an overcurrent situation as described earlier. However, because the restricted value of the output current Io is fixed even if the voltage $V_{IN}$ changes, when the voltage $V_{IN}$ becomes high and makes a source-drain voltage also high, it is possible that resultant heat causes the MOSFET 1 to break down.

For such a stabilized DC power supply device configured in such a way that the output transistor is incorporated in the semiconductor integrated circuit, it is possible to activate a thermal shutdown and thereby prevent the output transistor from breaking down by heat. However, it is not possible to measure the temperature in proximity to the output transistor used for the conventional stabilized DC power supply device shown in FIG. 3, because the output transistor is connected externally.

Note that a power unit disclosed by the Japanese Patent Application Laid-Open No. H8-123560 reduces the output voltage fluctuation of the power unit which is a power regulator, and stabilizes voltage to be fed to a load device. Therefore, the invention is not purposed for preventing an FET that forms the regulator from breaking down by heat.

SUMMARY OF THE INVENTION

An object of the present invention is to provide a stabilized DC power supply device capable of preventing an output transistor from breaking down by heat even if the output transistor is connected externally.

To achieve the above object, according to one aspect of the present invention, the stabilized DC power supply device embodying the invention is so configured as to comprise an output transistor for converting an input voltage to an output voltage and feeding out the output voltage, a control circuit for controlling the output transistor so as to maintain a value of the output voltage constant, a current detection circuit for detecting an output current of the output transistor, a voltage detection circuit for detecting a voltage appearing between an input side and an output side of the output transistor, a multiplying circuit for multiplying an output of the current detection circuit and an output of the voltage detection circuit together, and a protection circuit for restricting a wattage power of the output transistor according to an output of the multiplying circuit.

It is possible, in addition to the above-mentioned configuration, to configure in such a way that, at least, the control circuit is incorporated into a semiconductor integrated circuit and the output transistor is connected externally with respect to the semiconductor integrated circuit.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
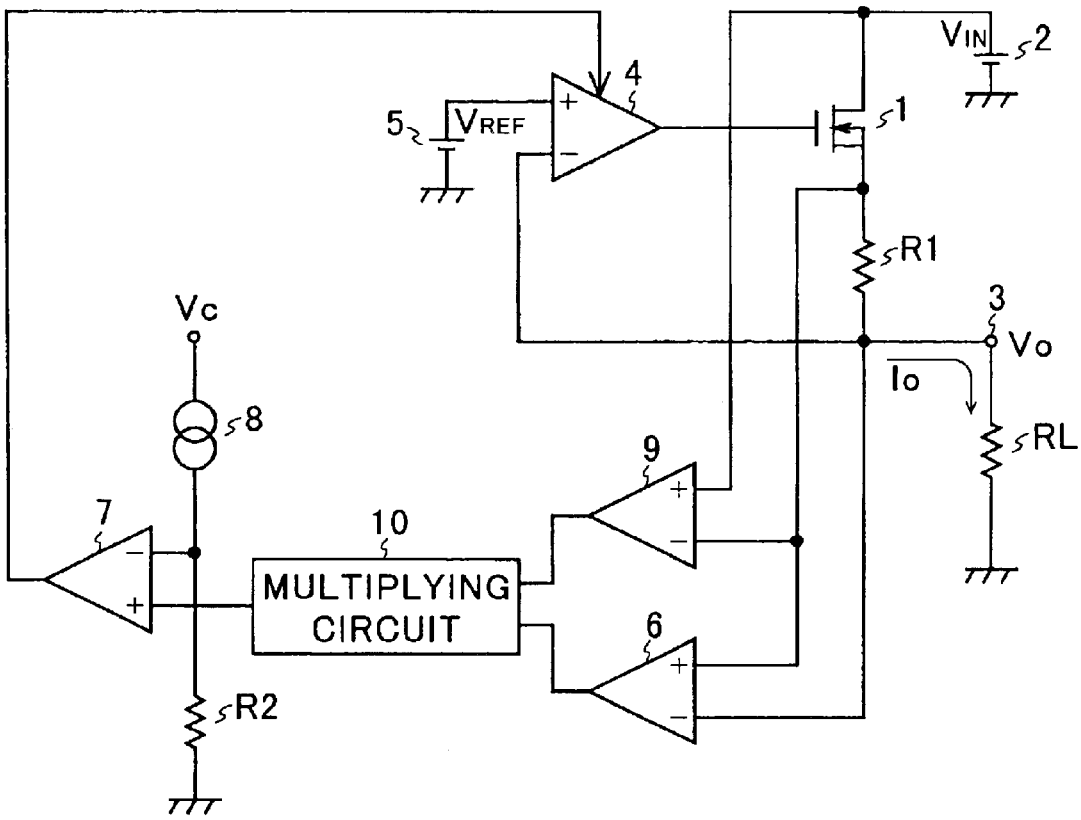
FIG. 1 is a circuit diagram showing a configuration example of a stabilized DC power supply device embodying the invention.

Hereinafter, embodiments of the present invention will be described with reference to the accompanying drawings. FIG. 1 is a circuit diagram showing a configuration example of a stabilized DC power supply device embodying the invention. Such identical portions as are found also in FIG. 3 are identified with the same reference numerals, and overlapping descriptions will not be repeated.

Figure 3:
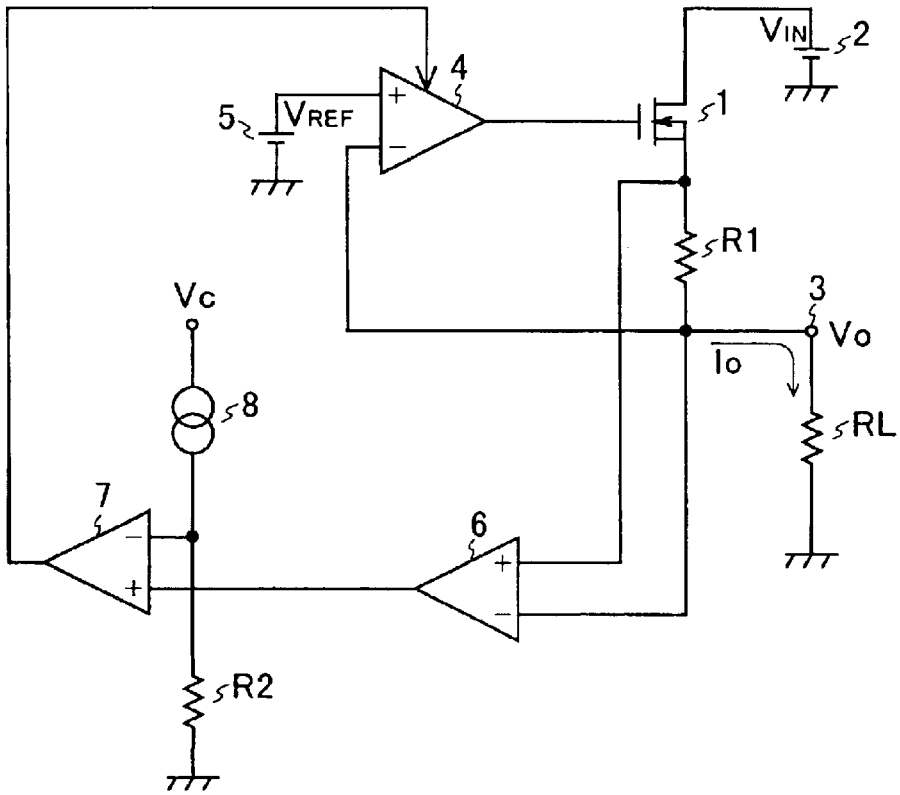
Prior Art Fig. 3
FIG. 3 is a circuit diagram showing a configuration example of a conventional stabilized DC power supply device.
Figure 4:
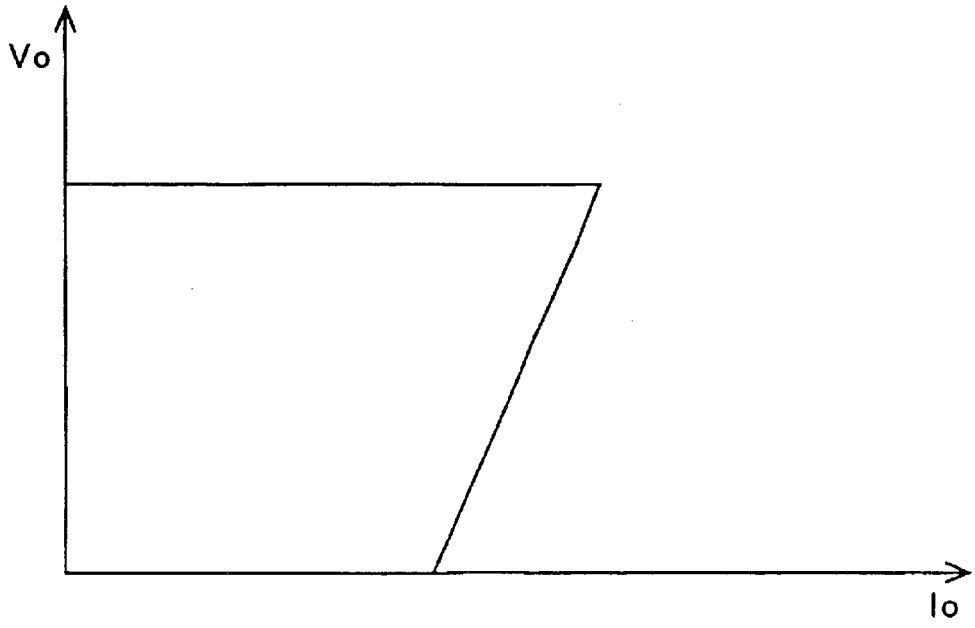
Prior Art Fig. 4
FIG. 4 is a schematic diagram showing a Vo-Io characteristic of the stabilized DC power supply device shown in FIG. 3.

The stabilized DC power supply device embodying the invention shown in FIG. 1 is configured in such a way that an operational amplifier 9 and a multiplying circuit 10 are newly provided to the conventional stabilized DC power supply device shown in FIG. 3. The stabilized DC power supply device shown in FIG. 1 is configured in such a way that the operational amplifier 4, the operational amplifier 6, the operational amplifier 7, the constant current source 8, the operational amplifier 9, and the multiplying circuit 10 are incorporated in a single semiconductor integrated circuit. To that semiconductor integrated circuit, the MOSFET 1, the current-sensing resistor R1, and the external resistor R2 are externally connected respectively.

A non-inverting input terminal of the operational amplifier 9 is connected to a node between the drain of the MOSFET 1 and the DC voltage source 2. An inverting input terminal of the operational amplifier 9 is connected to a node between the source of the MOSFET 1, resistor R1, and the non-inverting input terminal of the operational amplifier 6.

Furthermore, the output terminal of the operational amplifier 6 and the non-inverting input terminal of the operational amplifier 7 are not connected to each other directly as in the case of the conventional stabilized DC power supply device shown in FIG. 3, but connected to each other through the multiplying circuit 10. The output terminal of the operational amplifier 6 is connected to one input side of the multiplying circuit 10, and an output terminal of the operational amplifier 9 is connected to another input side of the multiplying circuit 10. Moreover, an output side of the multiplying circuit 10 is connected to the non-inverting input terminal of the operational amplifier 7.

The operational amplifier 9 detects the source-drain voltage of the MOSFET 1 and feeds out a voltage signal corresponding to the detected voltage. Furthermore, the operational amplifier 6 detects the drain current of the MOSFET 1 and outputs a voltage signal corresponding to the detected current. The multiplying circuit 10 multiplies the output of the operational amplifier 9 and the output of the operational amplifier 6 together. As a result, the output of the multiplying circuit 10 becomes proportional to an wattage power of the MOSFET 1. The output of the multiplying circuit 10 is fed to the operational amplifier 7.

The operational amplifier 7 generates a control signal in accordance with a voltage difference between the output of the multiplying circuit 10, that is, a value proportional to the wattage power of the MOSFET 1, and a voltage determined by a resistance value of the external resistor R2, and then feeds out the control signal to the operational amplifier 4. By this arrangement, a gain of the operational amplifier 4 is controlled by the control signal fed from the operational amplifier 7 so that the wattage power of the MOSFET 1 is kept under a predetermined value.

Figure 2:
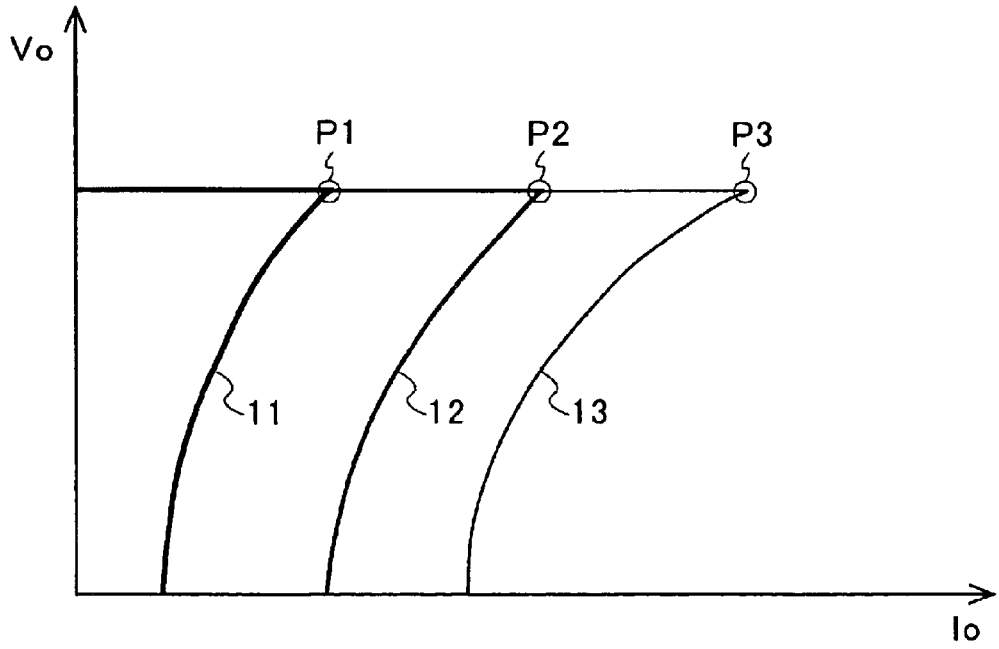
FIG. 2 is a schematic diagram showing a Vo-Io characteristic of the stabilized DC power supply device shown in FIG. 1.

As a result of this, the Vo-Io characteristic of the stabilized DC power supply device embodying the invention and shown in FIG. 1 will be as such shown in FIG. 2. The Vo-Io characteristics shown in FIG. 2 are for cases in which the voltage $V_{IN}$ is changed in three levels respectively.

A Vo-Io characteristic curve 11 shows a case when the voltage $V_{IN}$ is the highest, a Vo-Io characteristic curve 12 shows a case when the voltage $V_{IN}$ is the second highest, and a Vo-Io characteristic curve 13 shows a case when the voltage $V_{IN}$ is the lowest.

It is understood that the higher the voltage $V_{IN}$ is, the higher the source-drain voltage of the MOSFET 1 becomes, the smaller the drain current required for the MOSFET 1 to produce the predetermined value of the wattage becomes, and the smaller a restricted value of the output current Io becomes (refer to points P1, P2, and P3 in FIG. 2).

As described, when the voltage $V_{IN}$ changes, the restricted value of the output current Io also changes accordingly. Therefore, in the Vo-Io characteristic, the wattage of the MOSFET 1 is equal to a wattage set by the resistance value of the external resistor R2 at any given point at which the output voltage Vo is reduced after the restriction is placed on the output current Io. This means that a Vo-Io characteristic in accordance with the wattage set by the resistance value of the external resister R2 can be obtained within a range where the output current Io is restricted. This way makes it possible to prevent the MOSFET 1 from breaking down by heat.

Furthermore, in the stabilized DC power supply device embodying the invention and shown in FIG. 1, because the drain current and the drain-source voltage are detected, and the wattage of the MOSFET 1 is obtained from the detected values, it is not necessary to take the property of the MOSFET 1 per se into account. Because of this reason, a protection circuit formed by the current-sensing resistor R1, the external resistor R2, the operational amplifier 6, the operational amplifier 7, the constant current source 8, the operational amplifier 9, and the multiplying circuit 10 is capable of responding to any type of FET. It is also possible to use another type of transistor in lieu of the FET.

Furthermore, in the stabilized DC power supply device embodying the invention and shown in FIG. 1, because the restricted value of the wattage of the MOSFET 1 is set by the resistance value of the external resistor R2, it is possible to change the restricted value of the wattage of the MOSFET 1 easily by changing a type of the external resistor R2. Therefore, the stabilized DC power supply device is capable of responding to any type of output transistors. In addition, it is also easy to change the current-sensing resistor R1 to another type according to the drain current of the output transistor, because the current-sensing resistor R1 is an externally connected resistor.

Note that, it is desirable that a highly accurate operational amplifier be used as the operational amplifier 6, because the resistance value of the current-sensing resistor R1 is set at a smaller value (usually scores of mΩ to hundreds of mΩ) so as to reduce a loss of power incurred by the current-sensing resistor R1. At the same time, it is also desirable that an operational amplifier with a wide dynamic range be used as the operational amplifier 9, because the source-drain voltage of the MOSFET 1 may become extremely high when a load connected to the output terminal 3 causes a short circuit and the output voltage Vo is turned to zero.

Although the stabilized DC power supply device having an output transistor connected externally is described in this embodiment, the stabilized DC power supply device relating to the invention is not limited to such a type, and a stabilized DC power supply device formed by a semiconductor integrated circuit incorporating the output transistor therein can also be used.

What is claimed is:

1. A stabilized DC power supply device comprising:

an output transistor for converting an input voltage to an output voltage and feeding out the output voltage;

a control circuit for controlling the output transistor so as to maintain a value of the output voltage constant;

a current detection circuit for detecting an output current of the output transistor;

a voltage detection circuit for detecting a voltage appearing between an input side and an output side of the output transistor;

a multiplying circuit for multiplying an output of the current detection circuit and an output of the voltage detection circuit together; and a protection circuit for restricting a wattage power of the output transistor according to an output of the multiplying circuit.

2. A stabilized DC power supply device as claimed in claim 1, wherein, at least the control circuit is incorporated into a semiconductor integrated circuit and the output transistor is connected externally with respect to the semiconductor integrated circuit.

3. A stabilized DC power supply device as claimed in claim 1, wherein the current detection circuit comprises a current-sensing resistor through which the output current of the output transistor flows and an operational amplifier that detects a voltage across the current-sensing resistor; and at least the control circuit is incorporated into a semiconductor integrated circuit and the current-sensing resistor is connected externally with respect to the semiconductor integrated circuit.

4. A stabilized DC power supply device as claimed in claim 1, wherein the protection circuit has a resistor and a restricted value of the wattage power of the output transistor is set by a resistance value of the resistor; and at least the control circuit is incorporated into a semiconductor integrated circuit and the resistor is connected externally with respect to the semiconductor integrated circuit.

5. A stabilized DC power supply device as claimed in claim 1, wherein the current detection circuit comprises a current-sensing resistor through which the output current of the output transistor flows and an operational amplifier that detects a voltage across the current-sensing resistor;

the protection circuit has a resistor and a restricted value of the wattage power of the output transistor is set by a resistance value of the resistor; and at least the control circuit is incorporated into a semiconductor integrated circuit, and the output transistor, the current-sensing resistor, and the resistor are connected externally with respect to the semiconductor integrated circuit.

* * * * *